United States Patent [19]

Herrmann

[11] 4,245,567

[45] Jan. 20, 1981

[54] SAFE DOOR BOLT

[76] Inventor: John C. Herrmann, 101 S. Fuller Ave., Los Angeles, Calif. 90036

[21] Appl. No.: 68,947

[22] Filed: Aug. 23, 1979

[51] Int. Cl.[3] ..... E05G 1/04

[52] U.S. Cl. ..... 109/64; 70/1.5

[58] Field of Search ..... 70/1.5; 109/64, 59

[56] References Cited

U.S. PATENT DOCUMENTS

| | | | |
|---|---|---|---|
| 2,947,160 | 8/1960 | Wolters | 109/59 |
| 3,104,538 | 9/1963 | Roberts et al. | 70/1.5 |
| 3,158,017 | 11/1964 | Guze, Jr. | 70/1.5 |

*Primary Examiner*—Reinaldo P. Machado
*Attorney, Agent, or Firm*—Ralph B. Pastoriza

[57] ABSTRACT

A safe door bolt is rendered substantially punch-proof by providing as a part of the bolt a hardened plug. This plug has a tapered portion positioned to cause radial expansion of material forming part of the bolt in response to an end blow delivered to the bolt attempting to retract the same into the door. Thus, any force in the form of a sudden axial blow to the end of the door bolt by a burglar will result in the radial expansion of material of the bolt to block its retraction into the guide bore of the safe door thereby frustrating burglary attempts.

2 Claims, 4 Drawing Figures

SAFE DOOR BOLT

This invention relates generally to safes and more particularly to a safe door bolt so designed as to be substantially punch-proof.

BACKGROUND OF THE INVENTION

U.S. Pat. No. 3,158,017 issued Nov. 24, 1964 entitled BURGLAR PROOF SAFE LOCKING BOLT ASSEMBLY is illustrative of a typical prior art safe door construction of the type with which the present invention is concerned. Basically, the types of safe doors shown in this patent comprise a massive body provided with a circular recess defining an annular wall. Bolt guiding bores extend radially through this wall for receiving locking bolts. The bolts in turn may be retracted and extended by an appropriate cam plate received in the recess and arranged to rotate between first and second positions. The inner ends of the bolts are provided with grooves receiving the outer edge of the cam plate and appropriate cam slots are provided through which pins extending transversely of the grooves in the ends of the bolts pass to hold the bolts captive to the cam plate. The arrangement is such that all the bolts involved, normally three spaced at 120° are simultaneously retracted or extended by rotations of the cam plate through a given circumferential distance.

One of the common ways of burglarizing safes of the above type is to drill into the safe body wall from the side and punch back the locking bolts using a sledge hammer and a punch or metal rod. If the three bolts involved can be forced radially into the door structure, then the door can readily be removed and provide access to the safe.

The above-mentioned prior patent illustrates one manner of frustrating such attempts to burglarize a safe. More particularly, in accord with the teachings of this patent there is provided a triangular shaped plate member cooperating with the normally provided cam plate to distribute any inward force exerted on a bolt to the other two bolts involved thereby tending to drive these latter bolts outwardly.

Another means of dealing with the above problem is disclosed in part in my copending U.S. Pat. application Ser. No. 68,948 filed Aug. 23, 1979 and entitled SAFE DOOR. In this latter invention, the cam plate itself is appropriately dimensioned and coupled to the inner ends of the bolts in such a manner that it serves to absorb much of a radially inwardly directed blow against one of the bolts, the action in effect causing the cam plate to engage the opposite wall of the recess so that the whole strength of the door body absorbs such shock.

BRIEF DESCRIPTION OF THE PRESENT INVENTION

Bearing the foregoing in mind, the present invention contemplates still another means for inhibiting retraction of bolts into a safe door by action of a burglar wherein the action is provided wholly by the bolt construction itself.

More particularly, in accord with the present invention, the safe door bolt includes a coaxially positioned hardened plug having a radially inwardly tapered portion extending over a given axial distance. A portion of the bolt exterior of the bore when the bolt is in extended position includes radially expandable means for engagement with the tapered portion of the plug. The arrangement is such that an axially applied end blow to the bolt causes relative axial movement between the plug and expandable means to result in driving of the expandable means radially outwardly to engage the outer periphery of the exit opening of the guide bore and thereby block retracting movement of the bolt into the door.

BRIEF DESCRIPTION OF THE DRAWINGS

A better understanding of this invention will be had by now referring to two embodiments thereof as illustrated in the accompanying drawings in which.

DETAILED DESCRIPTION OF THE INVENTION

Figure 1:
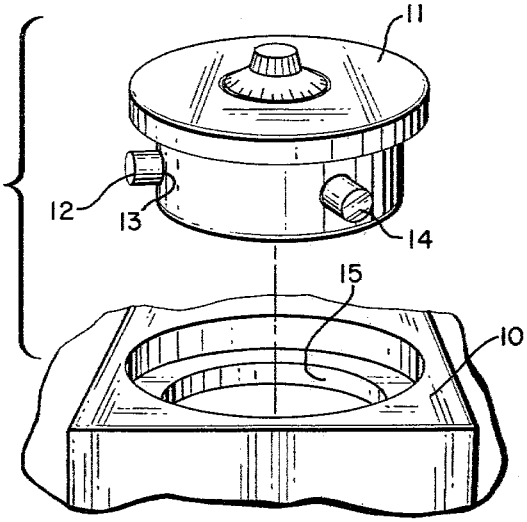
FIG. 1 is a fragmentary exploded perspective view showing a typical safe door separated from the safe body itself.

Referring first to FIG. 1, there is shown a safe 10 arranged to be closed by safe door 11. Safe door 11 includes a lateral bolt 12 for radial movement through a guiding bore 13 formed in a side wall portion of the door 11. This movement is between extended locking positions and retracted open position. In FIG. 1, three such bolts are provided spaced at 120°, a second one of the bolts being indicated at 14.

When the bolts such as 12 and 14 are retracted into the door 11, it may be positioned over the opening of the safe 10 and when the bolts are then again extended, they will underlie an appropriate ledge portion 15 constituting part of the upper safe wall thereby securing the door 11 in locked position.

Figure 2:
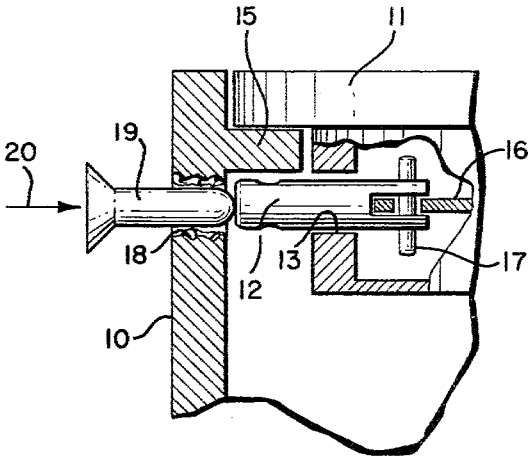
FIG. 2 is a fragmentary cross section showing certain portions in full lines and other portions partially cut away of the safe door in locked position on the safe and wherein a burglary is taking place.

The foregoing will be evident from the fragmentary cross section of FIG. 2 which shows the bolt 12 in extended position underlying the opening wall portion of flange 15.

Bolt 12 is typical of the other bolts such as 14 shown in FIG. 1 and thus a detailed description of this bolt will suffice for all.

As indicated in FIG. 2, the inner end of the bolt 12 is coupled to a cam plate 16 as by an appropriate pin 17 passing through a cam slot formed in the cam plate 16. The cam slot extends circumferentially and radially along a path segment such that a rotation of the cam plate in its own plane will effect an extension or retraction of the bolt 12 as well as the other bolts all simultaneously.

Since the present invention is concerned with a bolt construction for the bolt 12 rather than other portions of the door safe, further description of the interior of the door is deemed unnecessary. Reference is had, however, to Applicant's copending application set forth herein for further details as to operation of the cam plate.

FIG. 2 in addition to the showing of the bolt in its locked position also illustrates a common means of burglarizing the safe. Basically, the burglar will drill or in some other manner form a hole opposite the extending end of each of the bolts in the side wall of the safe 10. Such hole is illustrated at 18 in FIG. 2. The burglar can then place a rod or punch 19 against the extending end of the bolt 12 and pound the other end in the direction of the arrow 20 with a sledge hammer. For many types of safes, the blow is sufficient to retract the bolt 12, the action resulting in bending or fracture of the cam plate 16.

The present invention provides an improved bolt structure which will inhibit radial retraction of the bolt under such a blow.

Figure 3:
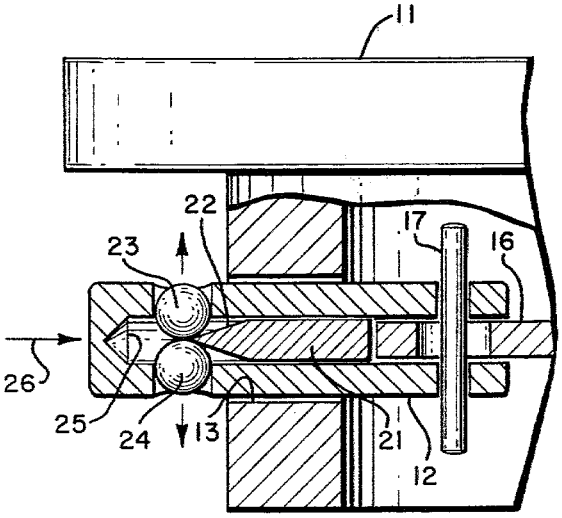
FIG. 3 is a greatly enlarged view of the bolt of FIG. 2 partly in cross section illustrating a first and preferred embodiment of this invention.

More particularly, and with reference to FIG. 3 illustrating details of the bolt 12, the manner in which the bolt is designed to inhibit forced radially inward movement thereof will be described. As shown, the bolt includes a hardened plug 21 coaxially positioned in the interior of the bolt 12 as shown. This plug includes a radially inwardly tapered portion 22 extending over a given axial distance. A portion of the bolt 12 exterior of the guide bore 13, in turn, includes radially expandable means positioned for engagement with the tapered portion of the plug.

In the embodiment illustrated in FIG. 3, the foregoing radially expandable means takes the form of two hardened ball bearings 23 and 24 force fitted into lateral openings on either side of the axis of the bolt and of diameter no greater than one half the diameter of the bolt. By such dimensioning, the balls are normally flush with the outer cylindrical surface of the bolt. Also, it will be noted that a cavity 25 is positioned axially on the opposite side of the balls from the tapered end 22 of the plug 21.

If the end of the bolt is now subjected to an axially applied blow as indicated by the arrow 26 in FIG. 3, the softer material making up the bolt portion other than the hardened plug 21 will tend to drive the hardened balls 23 and 24 to the right or into the guide bore 13 as viewed in FIG. 3. However, the hardened plug 21 itself will be prevented from inward axial movement by the outer edge of the cam plate 16 and its tapered portion 22 will effectively relatively move between the balls 23 and 24 to radially expand these balls. The ball bearings will thus be forced laterally outwardly and thereby block retraction of the bolt through the opening 13. It will be understood that the force fitted balls 23 and 24 are not driven completely away from the bolt but only caused to extend beyond the outer surface of the bolt a short distance normally less than the radius of the ball bearing to block any possibility of entry of the balls into the guide bore 13. Thus, while a slight inward movement of the bolt may result from the axial end blow, sufficient movement is not possible to free the bolt of the ledge or flange portion 15 of the safe itself described in FIG. 2. Further, the bolt will become hopelessly jammed in the guide bore 13 thus further frustrating any burglarizing attempts.

Figure 4:
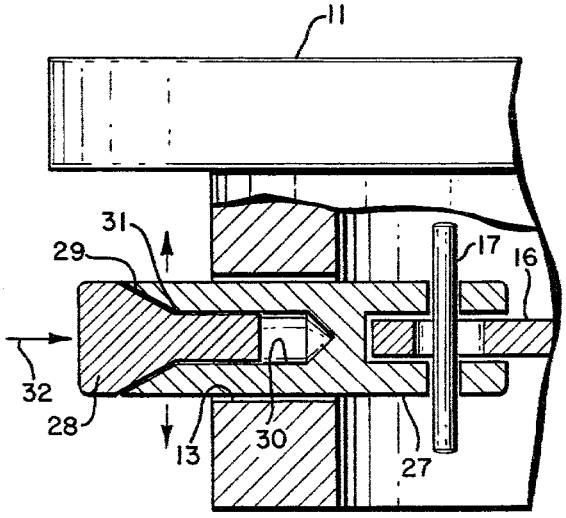
FIG. 4 is a view similar to FIG. 3 showing a bolt construction in accord with a second embodiment of this invention.

FIG. 4 shows a second embodiment wherein rather than the bolt 12 a different type of bolt is employed as indicated at 27. This bolt is coupled to the cam plate 16 with a pin 17 in the same manner as the bolt 12.

As in the case of the bolt 12, bolt 27 similarly includes a hardened plug 28 having a tapered portion 29 extending into a reduced diameter portion receivable in an end opening 30 in the bolt 27. Preferably the entrance of the end opening 30 for the bolt is internally beveled as at 31 to match the tapered portion 29, the initial left hand portion of the plug 28 having the same diameter as the bolt to provide an exterior flush cylindrical surface. It will be noted in FIG. 4 that the end opening 30 in the bolt 27 extends further than the inward extent of the hardened plug 28.

With the foregoing arrangement, if an axial end blow is applied to the bolt as indicated by the arrow 32, the hardened plug 28 will be driven inwardly, the tapered portion 29 radially expanding the surrounding bolt wall. In this particular embodiment, the expandable means thus constitutes the softer bolt material surrounding the hardened plug 28 and it will be appreciated that the expanded bolt wall by the hardened plug being driven inwardly will engage the periphery of the exit opening of the guide bore 13 thereby preventing any inward movement of the bolt 27.

As in the case of the hardened ball bearings of FIG. 3, the deformation of the surrounding bolt wall against the exit opening of the guide bore will hopelessly wedge the bolt in the door body and thus frustrate further attempts by the burglar to gain access to the safe.

From the foregoing description, it will thus be evident that the present invention has provided a novel bolt construction so designed as to frustrate attempts to burglarize a safe door by striking the ends of the extended bolts in an effort to retract them into the door.

I claim:

1. A safe door bolt for lateral movement through a guiding bore formed in a side wall portion of the door between extended and retracted positions to lock and open the door, respectively, said bolt including an internally coaxially positioned hardened plug having at one end a radially inwardly tapered portion extending over a given axial distance and pointing outwardly, a portion of said bolt including radially expandable means comprising two hardened ball bearings force-fitted into lateral openings on either side of the axis of said bolt and of diameter no greater than ½ the diameter of said bolt so as to be flush with the outer cylindrical surface of said bolt, exterior of said bore when said bolt is in extended position, said tapered portion of said plug being positioned to pass between said ball bearings when the outer end of said bolt is subjected to an axially applied blow causing relative axial movement between said plug and ball bearings to result in driving of said ball bearings radially outwardly to engage the outer periphery of the exit opening of said guide bore and thereby block retracting movement of said bolt into said door.

2. A safe door bolt for lateral movement through a guiding bore formed in a side wall portion of the door between extended and retracted positions to lock and open the door, respectively, said bolt including a coaxially positioned hardened plug having an end portion of the same diameter as said bolt, said end portion thence reducing in diameter to define a tapered portion, the remaining portion of said bolt having an end opening axially receiving the tapered portion of said plug and an interior bevel at the entrance to said end opening to match said tapered portion and provide a smooth cylindrical outer surface, the axial extent of said end opening being greater than the axial extent of said tapered portion of said plug, and the material of said bolt other than that of said plug being softer than said plug whereby when said bolt is struck with an axial blow, said plug is driven further into said end opening, said tapered portion thereby radially expanding the surrounding wall of the bolt to thereby block retraction of the bolt through said guide bore.

* * * * *